US005516337A

United States Patent [19]

Nguyen

[11] Patent Number: 5,516,337

[45] Date of Patent: May 14, 1996

[54] CHEMICAL SYSTEM FOR PROVIDING FIBROUS MATERIALS WITH STAIN RESISTANCE

[75] Inventor: Van G. Nguyen, St. Clair, Australia

[73] Assignee: Minnesota Mining and Manufacturing Company, Saint Paul, Minn.

[21] Appl. No.: 367,211

[22] PCT Filed: Aug. 27, 1993

[86] PCT No.: PCT/US93/08126

§ 371 Date: Jan. 10, 1995

§ 102(e) Date: Jan. 10, 1995

[87] PCT Pub. No.: WO94/05848

PCT Pub. Date: Mar. 17, 1994

[30] Foreign Application Priority Data

Sep. 2, 1992 [AU] Australia ..... PL4465

[51] Int. Cl.[6] ..... D06P 1/673; D06P 3/14; D06P 5/08; D06M 17/00

[52] U.S. Cl. ..... 8/557; 8/625; 8/626; 8/602; 8/589; 8/128.3; 8/908; 8/912; 8/917; 428/270; 428/88; 428/91; 428/96; 428/97; 106/2; 427/389; 427/393.4; 427/430.1; 427/434.2

[58] Field of Search ..... 8/552, 558, 615, 8/625, 626, 115.6, 128.1, 128.3, 908, 912, 929, 930; 428/270, 88, 91, 96, 97; 106/2; 427/389, 393.4, 430.1, 434.2

[56] References Cited

U.S. PATENT DOCUMENTS

| | | |
|---|---|---|
| 3,398,182 | 8/1968 | Guenthner et al. . |
| 3,574,791 | 4/1971 | Sherman et al. . |
| 3,905,762 | 9/1975 | Lehinant et al. . |
| 4,024,178 | 5/1977 | Landucci . |
| 4,147,851 | 4/1979 | Raynolds . |
| 4,264,484 | 4/1981 | Patel . |
| 4,274,831 | 6/1981 | Belfort et al. . |
| 4,401,780 | 8/1983 | Steel . |
| 4,540,497 | 9/1985 | Chang et al. . |
| 4,606,737 | 8/1986 | Stern . |
| 4,822,373 | 4/1989 | Olson et al. . |
| 4,875,901 | 10/1989 | Payet et al. . |
| 4,925,707 | 5/1990 | Vinod . |
| 4,937,123 | 6/1990 | Chang et al. . |
| 4,948,650 | 8/1990 | Fitzgerald et al. . |
| 5,030,245 | 7/1991 | Hemling et al. . |
| 5,073,442 | 12/1991 | Knowlton et al. . |
| 5,098,774 | 3/1995 | Chang . |
| 5,328,766 | 7/1994 | Smith ..... 428/378 |

FOREIGN PATENT DOCUMENTS

| | | |
|---|---|---|
| 294081 | 12/1988 | European Pat. Off. . |
| 322955 | 7/1989 | European Pat. Off. . |
| 353080 | 1/1990 | European Pat. Off. . |
| 417960 | 3/1991 | European Pat. Off. . |
| WO91/03593 | 3/1991 | WIPO . |

*Primary Examiner*—Margaret Einsmann
*Attorney, Agent, or Firm*—Douglas B. Little; Gary L. Griswold; Walter N. Kirn

[57] ABSTRACT

Method for imparting stain resistance to fibers, especially wool, which is adaptable to current wool processing methods. Steps comprise:

A. treating fibers with a mordant;

B. treatment with a combination of sulfonated or disulphonated surfactant together with a stain resist (e.g., syntan); and C. providing treatment with a fluorochemical in either step A. or B. in an amount sufficient to improve stain resistant properties. The improved method may be undertaken in the liquor remaining in a dye bath after dyeing fiber (spent bath process). Process pH is acid. Advantage: lowers the proportion of stain resist chemical to wool necessary to impart stain resistance. Tip sealing, using polymethacrylic resin and fluorochemical, may be an added step.

17 Claims, No Drawings

CHEMICAL SYSTEM FOR PROVIDING FIBROUS MATERIALS WITH STAIN RESISTANCE

TECHNICAL FIELD

This invention relates to a chemical system for providing fibrous materials with stain resistance to common household stains, particularly acid colorants. Although the system is useful for the treatment of synthetic materials such as nylon, its principal application is in respect of keratinous materials of which wool is of first importance.

BACKGROUND

Keratinous articles such as wool carpets are susceptible to staining by natural and artificial colorants including acid colorants commonly found in many foods and beverages. A need has long been felt for processes for economically providing such keratinous articles with resistance to staining. Particularly desirable are processes by which durable stain resistance can be imparted to keratinous articles during conventional processing and treating operations.

The object of this invention is to provide a system for the protective treatment of fibrous materials, particularly wool carpets, such system being reasonably durable through wearing (dryfastness) and wet cleaning (wetfastness).

DISCLOSURE OF INVENTION

The present invention provides a chemical system for imparting to fibrous, particularly keratinous materials, such as wool fibers used in carpets, stain resistance to common household stains particularly acid colorants. The method involves first treating the fibrous material with a mordant. After mordant treatment, the fiber is subjected to a bath which includes a surfactant, stain resist chemical, a fluorochemical and, if required, an acid to lower the bath pH. A tip sealing process to enhance the carpet surface protection may also be utilized as a final treatment, if desired.

The method of this invention can be applied to undyed fibers or to already dyed fibers. Where it is desired to provide a dyed fibrous product with stain resistance in accordance with the method of this invention, the product may be pre-dyed or the mordant may be incorporated in the bath in which the fiber is dyed. Further, the process of this invention, when incident to the dyeing of fabric, is useful with nonmordant dyes as well as with mordant dyes. The process of this invention is useful with finished fabrics as well as with unfinished fabrics.

DETAILED DESCRIPTION

Broadly, the process of manufacturing woolen carpets involves the following steps:

1. Wool is cropped from the sheep and is processed in a scouring bath where the wool is cleaned and bleached, the end product being known as wool stock fiber.
2. The stock fiber is blended.
3. The blended stock fiber is carded.
4. The carded wool stock fiber is spun.
5. The spun wool stock fiber is twisted.
6. The twisted wool stock fiber is formed into a hank.
7. The hank is formed into a cone.
8. Tufting is effected.

9. A backing is provided to the tufted wool, thus forming a woolen carpet.

Where wool is fiber treated the process of this invention may be applied to the fiber at any appropriate stage, e.g., to the original wool stock fiber before it is blended, to the hank of wool before it is coned, or to the tufted wool in which case a continuous dyeing and stain resistant applying process is required.

When the process of this invention is applied either to the stock fiber before blending or to the hank of wool before it is coned, and where a dyed end product is required the process involves the addition to the normal dye bath (which comprises dye and optionally any other suitable auxiliary agents such as mothproofing agents, leveling agents, applied to ensure even distribution of the dye through the fiber, and the like) of a mordant, which is preferably a trivalent mordant such as aluminum sulfate $Al_2(SO_4)_3$ or aluminum hydroxide $Al(OH)_3$ or a tetravalent mordant such as zirconium sulfate $Zr(SO_4)_2$ or zirconium hydroxide $Zr(OH)_4$. The mordant is included in the dye bath in an amount effective to impart to the fiber greater stain resistance than would be obtained in the absence of the mordant, preferably in a ratio of from 0.5 to 2% by weight relative to the weight of fiber in the bath. The bath temperature can be elevated (e.g.) to 80°–98° C. if necessary in order to exhaust the dye into the fabric. As indicated above, the mordant used in the first step of the process of this invention, is utilized whether the dye is a mordant or a nonmordant dye.

After the dyeing cycle is completed, the bath is emptied to remove all dye auxiliaries, that is to say all fluid remaining in the bath after the dyeing process is completed.

The bath containing the now dyed fiber is then refilled with cold water in a ratio of 15–100:1 by weight relative to weight of wool. Into this refilled bath is added a surfactant, preferably an anionic surfactant in an amount effective as a synthetic tanning (syntan) agent and to allow the diffusion of a syntan into the cortex region of the wool fiber, preferably in the ratio of 0.5–1.5% by weight relative to the weight of wool in the bath. A fluorochemical is added to the bath in an amount sufficient to act in concert with a stain resist chemical to provide improved stain resist properties compared with a fabric treated in the same manner absent the fluorochemical, preferably in the ratio of 0.5–1.5% by weight relative to the weight of fiber. A stain resist chemical is added in an amount sufficient to substantially decrease adsorption of staining material and thus minimize the level of usage required to protect the wool fiber, preferably in the ratio of 1.5–5% by weight relative to the weight of fiber. If necessary, also added to the same bath is an acid, preferably a strong acid, sufficient to lower the pH of the bath to 1.5–3.0.

After the refilled bath mixture is completed, the refilled bath containing the fabric is held at a temperature and for a time sufficient to cause the fabric to absorb an amount of the components of the bath effective to impart stain release properties to the material. For example, the temperature of the refill bath can be raised to 45°–75° C. and the temperature held at this level for 15–60 minutes. The preferred bath temperature is 60°–65° C. and the preferred holding time is 20 minutes.

After this period of time, all liquid not absorbed is discharged from the refill bath, with water being added to assist cooling and to ensure overflowing of the bath to effect the appropriate liquid discharge. Absent the addition of water, the fiber may become unacceptably compact and stiff.

In addition to the above specified protective treatment, a further tip sealing process may, if desired, be implemented.

This tip sealing process is applied when the tufted wool is applied to the backing to form a carpet. The tip sealing compound, which is preferably in the form of a polymethacrylic resin associated with a surfactant blended fluorochemical, may be applied either by spraying or by foaming. This tip sealing process adds a further protective coating to the surface of the carpet, wool fiber being normally shorn to even height over the length of the carpet. Additional protection is afforded by the tip sealing process against acid colorants, foot staining (as by soil etc.) and particularly coffee stains. The polymethacrylic type resin and the surfactant blended fluorochemical are mixed and added to the carpet surface with 0.25%–1.0% resin by weight and 0.25%–1% surfactant blended fluorochemical by weight relative to the weight of wool fiber.

Reverting to the protective system which is fundamental to this invention, it should be noted that the fluorochemical used in this process adds some lubricant properties to the fiber to which the system is applied. During blending of wool stock fibers, it is conventional to add a suitable spinning lubricant which is useful when the wool is spun. The use of the aforesaid fluorochemical in the system of this invention allows reduction in the quantity of that spinning lubricant used to between 40 and 60% of the normal concentration thereof.

As an alternative to the refilled bath process, a spent bath method may be utilized. In this "spent bath" process, rather than emptying the bath after the dyeing cycle is completed the spent bath (i.e., bath liquid remaining after dyeing is effected) is cooled to a temperature, and held at that temperature for a specific period, appropriate for stain release properties to be imparted to the material. Thus, the spent bath is at 65°–75° C., preferably 68°–70° C., and is maintained at this temperature for 10 to 40, preferably 30 minutes, and the stain resist chemical added. Acid is then added to adjust the pH of the resultant bath to a level of 2.0 to 2.5. The fluorochemical may be added either after the dyestuff or before the addition of the stain resist chemical. The desired fluorochemical level is 0.3–1.0% by weight of fiber.

This alternative process will be seen to save processing time since the bath is not emptied (discharged) after dyeing is effected and the bath temperature need not be elevated from atmospheric temperature as is the case when the bath is refilled.

As indicated above, the process of this invention can be applied at any convenient stage of the manufacturing process, preferably to the stock fiber before the stock fiber is blended or to the fiber in hank form before it is coned.

However, the process of the invention can be applied to keratinous or other fiber after tufting. It is preferred in such an instance to use an embodiment of the invention which provides a continuous rather than a two stage process. In this embodiment the tufted undyed fiber is admitted to a prewetting station and a surfactant, preferably anionic, added in a weight ratio of 0.5 to 4% per weight of surfactant based on the wet-pickup percentage weight of the fiber which is in the order of 80 to 100%. A mordant, preferably a trivalent mordant, is added in the weight ratio of from 0.5 to 2% based on the wet-pickup percentage of the fiber. Thereafter, to the fluid dyer or overflow applicators or pad mangles to 200–600% wet-pickup percentage of the fiber with a Brookfield viscosity of 40–60 cps, is added an anionic surfactant from 0.5 to 4% by weight, divalent salt from 0.5 to 2% by weight, an anionic fluorochemical from 0.5 to 2% by weight, a stain resist chemical from 1.5 to 5% by weight and, if necessary, an acid to lower the pH of the solution to 1.5–3.0.

The so treated carpet is steamed for 3 to 10 minutes with saturated steam and normal rinsing and extracting follows to a resulting 80–100% wet-pickup of fiber.

If it is desired to dye the tufted fiber in the process of this embodiment of the invention, dye is added contemporaneously with the fluorochemical and the stain resist chemical.

In either embodiment of the system of this invention the preferred chemicals are as follows:

The mordant can be any mordant suitable for use with the fiber to which the process of the invention is applied, e.g., those enumerated above and others known to those skilled in the art.

Likewise the surfactant can be any anionic, cationic, non-ionic, amphoteric or other surfactant suitable for use with the fiber. Anionic surfactants are preferred. Suitable anionic surfactants include: alkyl aryl sulphonated and hydroxyethylated fatty amine and its derivatives, such as Univadine PS-AU (Ciba-Geigy);

sodium alkyl diphenyl ether disulphonate, such as Pelex SS-L (Kao Corporation); sodium dodecyl diphenyl oxide disulphonate with high sulphur bond (containing ammonium thiosulphate) such as Pelex SS-H;

dodecyl (Sulfophenoxy) benzene sulphonic acid, disodium salt; oxybis (dodecylbenzene sulphonic acid) disodium salt such as Rhodacal DSB, Siponate DSB (Rhone Poulenc); hydrotrope sodium xylene sulfonate solution, Kemmat SN18 (Harcros Chemicals); aryl sulphonates, fatty amine polyglycol ether (sulphonate ethylene oxide condensate) such as TEBAN ES (Dr. TH. Böhme Chemie); sodium salt of highly sulphonated oil/ethylene oxide condensate, such as MATEXIL LA-NS (ICI); dodecyl (sulphophenoxy) benzene sulfonic acid, disodium salt—oxybis (dodecylbenzene sulphonic acid) disodium salts containing at least 1% sodium sulfate and at least 3% sodium chloride, such as Dowfax 2-Al (Dow Chemicals); general groups of alkylated diphenyl oxide disulphonates used as dispersants:

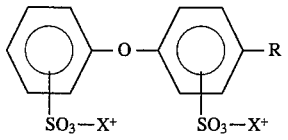

sulphated monoester of fatty acid, containing sodium salt such as LANKROPOL WN (Lankro Chemicals) or ammonium salt such as LANKROPOL WA (Lankro Chemicals) or potassium salt such as LANKROPOL OPA (Lankro Chemicals); and benzene sulphonic acid, dodecyl (sulphophenoxy) disodium salt, monosodium and didodecyl disulphonated diphenyl oxide such as CALFAX DB-45 (Pilot Chemicals).

The fluorochemical compositions useful in the present invention include anionic, cationic, or nonionic fluorochemicals such as the fluorochemical allophanates disclosed in U.S. Pat. No. 4,606,737 (Stern); fluorochemical polyacrylates disclosed in U.S. Pat. Nos. 3,574,791 (Sherman et al.) and 4,147,851 (Raynolds); fluorochemical urethanes disclosed in U.S. Pat. No. 3,398,182 (Guenthner et al.); fluorochemical carbodiimides disclosed in U.S. Pat. No. 4,024,178 (Landucci); fluorochemical guanidines disclosed in U.S. Pat. No. 4,540,497 (Chang et al.).

Preferred fluorochemicals include those described in detail in the Examples below.

The stain resist chemical (or stain blocker) can be any such chemical suitable for use with fiber materials, preferably keratinous, including sulfonated phenolic resins and derivatives such as FX-369 (3M),

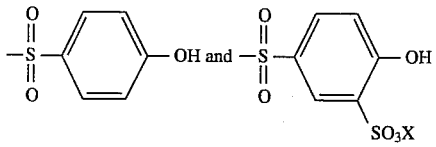

with at least 40% of the $SO_3X$ group and 40% of the

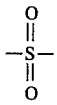

group; preferably leather syntans containing Naphthalene sulphones and derivatives such as PARALENE WXA (Napthalene sulfonic acid, formaldehyde and sulfonyl bis (phenol), sodium salts) (Yorkshire Chemicals)

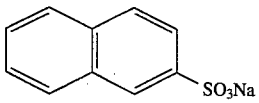

Other suitable stain resist chemicals can be readily selected by those skilled in the art.

The preferred stain release mixture, which includes the stain resist chemical and the surfactant is 62–80%, preferably 72% Paralene WXA, 13–25%, preferably 18.2% Kemmat SN18, and 7–13%, preferably 9.8% Siponate DSB.

The acid useful in the process, if required, is preferably a strong acid, e.g., sulphamic acid, formic acid or sulphuric acid.

The spinning lubricant is used at 40–60% of the normal level, (i.e. 40–60% of 0.8–1.2% of dry weight of wool) preferably at 0.4–0.6% to provide the dry spin method. The lubricant is selected to have low soiling attraction behavior. Suitable lubricants include Cirrasol ALN-W3 (alkoxylated glycerol and polyethylene glycol) (ICI Chemicals); or high humectant version Cirrasol ALN-W6 (ICI Chemicals); Crosslube DBS (Polyglycol and phosphate ester) (Crossfield Textile Chemicals); or Nopcostat 725-A (Polyethyxylated cetyl oleyl alcohol). The preferred moisture content added to the wool stock is in the range 14–17% and most preferably 14–15%.

The tip sealing compound preferably contains alpha olefin sulphonate and 0.25%–1.0% owg (on weight of good or percent based upon weight of fiber being 100%) of a polymethacrylate polymer such as a mixture comprising (a) about 23 parts of a copolymer of methacrylic acid (described as Polymer H of U.S. Pat. No. 4,937,123 (Chang et al) using butyl acrylate instead of ethyl acrylate and the weight ratios being about 78.4 parts methacrylic acid, about 17.6 parts butyl acrylate, about 2 parts sulfated castor oil, and about 2 parts NaOH); (b) about 3.4 parts a partially sulfonated novolak resin (FC-369 available from 3M); (c) about 8 parts (Witconate AOS at 39% solids); and about 64 parts water, and (d) 0.25%–1.0% owg of a fluoroaliphatic polymer, containing sorbitan, mono-9-octadecenoate such as a mixture as described in Example 8 of U.S. Pat. No. 4,264,484 (Patel) comprising (i) a fluoroaliphatic radical- and chlorine-containing ester and (ii) a water-insoluble addition polymer using a ratio of ester to addition polymer of about 1.7:2 rather than 1:2 with about 7.1 wt % (based on ester and addition polymer solids) Witconate AOS solids added.

An exhaustible fluorochemical will work in concert with the stain resist chemical to provide optimum oil, water and soil repellency in combination with the stain release properties (particularly acid colorant desorption) of the resist chemical.

Temperature: the rate of diffusion of the said stain resist chemical is particularly efficient in the range of 45°–80° C. without causing change of shade of the fiber or yarn, and the fluorochemical applied finds ideal condition of exhaustion of the dye into the fibers at temperature above 60° C. This temperature range allows a gentle yet efficient and even exhaustion.

pH conditions: while high temperature creates a favorable medium for the exhaustion of the chemicals, low pH conditions facilitate their fixation to wool fibers by ionic, hydrogen and covalent bonding. A pH range of 2.0–2.5 minimizes the yellowing effect often associated with sulphonated compounds.

The tip sealing process is particularly useful to enhance the overall performance of the stain resistance and stain release characteristics on wool carpets, particularly for cut pile carpets. It is novel to use polymethacrylic resin without rinsing without the fear of yellowing. This coupled with a fluoroaliphatic polymer containing a surfactant, facilitates penetration by migration. That the compound as described can be applied by spraying or by foaming is significant.

TEST RESULTS

By way of example only, tests of woolen carpet samples treated by the method of the current invention will now be described.

1. Stain Release Test

In the examples, the following staining test is adopted: IWS Test Method #282/1991 "Test Method for Assessing the staining propensity of Textiles floor coverings". This test assesses the staining propensity of specimens of finished wool carpet samples in the "new" and "used" states, i.e. before and after having been subjected to (simulated) foot traffic using FD&C food red staining medium. This test was designed to assess the effect and durability of stain resist finish on wool carpet. A 24 hour stain release rating of #6 on the unworn specimen is satisfactory; #7 rating is considered good and #8 rating is excellent.

A 24 hour stain release rating of #3 is satisfactory on worn specimen; of #5 is good and of #7 is excellent.

2. Stain Resistance Test

In the example, the following test is adopted: IWS Test Method No. 258/1985 "Test Method for assessing the oil and water repellency of textile floor coverings". This test assess the oil and water repellency properties of textile floor-coverings which have been given an antistain or anti-soil finish.

Minimum ratings of #4 oil (n-Tetradecane) and #3 water (70/30 water/isopropanol) are considered satisfactory.

3. Accelerated Soiling Test In the example, the following test is adopted: IWS Test Method No. 267/1991 "Test Method for Assessing the Soiling Propensity of Floorcoverings". The test is intended to assess the propensity of wool carpets to soiling using the artificial soil composition.

A minimum rating of #3 on the grey scale (ISO R105, Part 3) is considered satisfactory, rating of #4 is good and #5 is excellent.

4. Colorfastness to Light

In the examples, the following test is adopted: IWS Test Method No. 133/1985 "Colorfastness to Light of Textile Floorcoverings". This method is intended for determining the resistance of the color of wool and wool rich blend textile floor coverings to the action of an artificial light source whose spectrum corresponds closely to that of daylight. This method is based on the ISO 105–302: 1984 Colorfastness to light; Xenon arc.

Following ratings are considered satisfactory:

Standard depth: minimum of 5

Less and 1/12 standard depth: minimum of 4

First Fade: minimum of 3

I. EXAMPLE OF CONTINUOUS APPLICATION

In the example, a tufted 100% pre-dyed New Zealand wool carpet sample (100 g) was used, weighing 1422 gsm.

STEP 1—Prewet.

A pad mangle prewet station with wet pick up to 100% in which a liter of solution has the following ingredients:

0.5 g/L of Dioctyl sulphosuccinate wetting agent, such as Bevaloid 1299 (Rhone Poulenc).

0.5% OWG (5 g) of trivalent mordant Aluminum Sulphate.

STEP 2—Application.

An overflow applicator depositing 300% pick up of the following ingredients:

guar gum to Brookfield viscosity of 50 cps;

2% OWG (6.7 g) of anionic leveling agent Alkyl aryl sulphonated and hydroxyethylated fatty amines, such as Univadine PS-AU (Ciba-Geigy);

0.5% OWG (1.7 g) of divalent salt such as Magnesium Chloride;

0.75% OWG (2.5 g) of a mixture as described in Example 8 of U.S. Pat. No. 4,264,484 (Patel) comprising (i) a fluoroaliphatic radical- and chlorine-containing ester and (ii) a water-insoluble addition polymer using a ratio of ester to addition polymer of about 1.7:2 rather than 1:2 with about 7.1 wt % (based on ester and addition polymer solids) Witconate AOS solids added;

2% OWG (6.7 g) of Naphthalene sulphonic acid Paralene WXA (Yorkshire Chemicals); and pH 2.2 adjusted with sulphamic acid.

STEP 3—Fixation.

The so applied sample was submitted to saturated steam for 10 minutes to allow fixation. After 10 minutes, the sample was allowed to cool down for 1 minute then washed thoroughly and extracted to a moisture content of around 50% built-in moisture.

STEP 4—Tip sealing process.

The so moisture extracted sample received a tip sealing chemical oversprayed to 10% add-on with following mixture:

0.5% OWG of a mixture comprising (a) about 23 parts a copolymer of methacrylic acid (described as Polymer H of U.S. Pat. No. 4,937,123 (Chang et al) using butyl acrylate instead of ethyl acrylate and the weight ratios being about 78.4 parts methacrylic acid, about 17.6 parts butyl acrylate, about 2 parts sulfated castor oil, and about 2 parts NaOH); (b) about 3.4 parts a partially sulfonated novolak resin (FC-369 available from 3M); (c) about 8 parts (Witconate AOS at solids); and about 64 parts water; and 0.5% OWG of a mixture as described in Example 8 of U.S. Pat. No. 4,264,484 (Patel) comprising (i) a fluoroaliphatic radical- and chlorine-containing ester and (ii) a water-insoluble addition polymer using a ratio of ester to addition polymer of about 1.7:2 rather than 1:2 with about 7.1 wt % (based on ester and addition polymer solids) Witconate AOS solids added.

The sample then was subjected to drying and curing at 120 deg. C for 20 minutes. After conditioning to ambient room temperature, the sample was submitted to following tests with results as indicated below:

| TESTS | SAMPLE | MINIMUM STANDARD |
|---|---|---|
| STAIN RELEASE: 24h (IWS 282/1991) | | |
| unworn sample | 6.5–7.0 | 6.0 |
| worn sample | 4.0 | 3.0 |
| STAIN RESISTANCE: (IWS 258/1985) | | |
| Oil repellency | 5.0 | 4.0 |
| Water repellency | 3.0 | 3.0 |
| ACC. DRY SOIL: (IWS 267/1991) | 3.5 | 3.0 |
| COLORFASTNESS TO LIGHT: (IWS 133/1985) | N/A | N/A |
| Less than 1/12 | N/A | N/A |

Note: N/A means "not assessed".

II. EXAMPLE OF HANK PROCESS APPLICATION

STEP 1—Application of mordant

In the example, 7 kg of undyed wool hank was loaded in a hank dye machine. To the standard dye bath using pre-metallised dyes, 0.5% OWG (35%) was added as mordant. The dyeing process was carried out as per standard practice in a vertical mill whereby the dye liquor was raised to 98 deg. C over 50 minutes with 20 minutes holding at this temperature STEP 2—Exhaustion of protective chemicals. The bath was drained and refilled with cold water. (140 L of bath water = 20:1 liquor ratio) To this bath, the following chemicals were added:

2% OWG (140g) of Sodium alkyl diphenyl ether disulphonate such as Pelex SS-L (Kao Corp.)

2% OWG (140g) of Naphthalene sulphonic acid such as Paralene WXA (Yorkshire Chemicals).

0.75% OWG (52.5g).of fluorochemical composition comprising a mixture of (a) water-insoluble fluoroaliphatic radical- and aliphatic chlorine-containing ester; (b) water-insoluble fluoroaliphatic radical-containing polymer; and (c) water-insoluble fluoroaliphatic radical-containing compound selected from carbonylimino compounds and imine compounds described in example 14 of U.S. Pat. No. 4,401,780 (Steel) except that component (a) was about 69 Wt. %, component (b) was about 16 Wt. %, and component (c) was about 15 Wt. %.

The bath was recirculated for 5 minutes and added 1.6 g/L of Sulphamic acid (224g) adjusted to pH 2.4.

The temperature was then raised to 65 deg. C over minutes and held for 20 minutes at this temperature. The bath was then drained and refilled with cold water and rinsed for 10 minutes, then drained to drip dry.

STEP 3—Tip sealing process.

During the backing process, the tufted sample, using the provision of the treated yarn, was subjected to a topical tip sealing spray treatment to 10% moisture add-on, composing of the following ingredients:

0.5% OWG of polymethacrylic polymer being a mixture comprising about 23 parts (a) a copolymer of methacrylic acid (described as Polymer H of U.S. Pat. No. 4,937,123 (Chang et al) using butyl acrylate instead of ethyl acrylate and the weight ratios being about 78.4 parts methacrylic acid, about 17.6 parts butyl acrylate, about 2 parts sulfated castor oil, and about 2 parts NaOH); about 3.4 parts (b) a partially sulfonated novolak resin (FC-369 available from 3M); about 8 parts (c) (Witconate AOS at 39% solids); and about 64 parts water, 0.5% OWG of anionic fluoroaliphatic emulsion being a mixture as described in Example 8 of U.S. Pat. No. 4,264, 484 (Patel) comprising (a) a fluoroaliphatic radical- and chlorine-containing ester and (b) a water-insoluble addition polymer using a ratio of ester to addition polymer of about 1.7:2 rather than 1:2 with about 7.1 wt % (based on ester and addition polymer solids) Witconate AOS solids added.

The sample then was submitted to drying and curing for the same time as a latex backed hessian at a carpet mill.

After conditioning to ambient room temperature, the following tests were performed with results as indicated below:

| TESTS | SAMPLE | MINIMUM STANDARD |
|---|---|---|
| STAIN RELEASE: 24h (IWS 282/1991) | | |
| unworn sample | 6.0 | 6.0 |
| worn sample | 4.0 | 3.0 |
| STAIN RESISTANCE: | | |
| Oil repellency | 5.0 | 4.0 |
| Water repellency | 4.0 | 3.0 |
| ACC. DRY SOIL COLORFASTNESS TO LIGHT: | 3.5 | 3.0 |
| Less than 1/12 std depth | 4–5 | 4.0 |

(for test methods reference, see Continuous Application Example I)

III. EXAMPLE OF STOCK PROCESS APPLICATION

STEP 1—Application of mordant.

In the example, 70 kg of wool fleece in loose stock form was loaded into a commercial stock dye vat. The liquor ratio was 63:1.

0.5% OWG (350g) of Aluminum sulphate was added after the dyestuffs into the side tank and charged to the dye vat. The dyeing process was performed in the usual manner, using low temperature dyeing procedure. The bath was raised to 80 deg. C over 50 minutes and held at this temperature for 20 minutes.

The bath then was drained and the vat refilled with cold water.

STEP 2—Exhaustion of protective chemicals.

The refill bath had 63:1 liquor ratio. Following chemicals were added:

2% OWG (1.4 kg) of Sodium alkyl diphenyl ether disulphonate such as Pelex SS-L (Kao Corp.).

2% OWG (1.4 kg) of Napthalene sulfonic acid such as Paralene WXA (Yorkshire Chemicals).

0.75% OWG (0.530 kg) of fluorochemical composition comprising a mixture of (a) water-insoluble fluoroaliphatic radical- and aliphatic chlorine-containing ester; (b) water-insoluble fluoroaliphatic radical-containing polymer; and (c) water-insoluble fluoroaliphatic radical-containing compound selected from carbonylimino compounds and imine compounds described in example 14 of U.S. Pat. No. 4,401,780 (Steel) except that component (a) was about 69 Wt. %, component (b) was about 16 Wt. %, and component (c) was about 15 Wt. %.

The bath was recirculated for 5 minutes and 1.6 g/L of Sulphamic acid (7 kg) was added to achieve pH 2.4.

The temperature was ramped to 65 deg. C over 30 minutes and the bath was held at this temperature for 20 minutes. After this exhaustion procedure, the bath was drained and the stock rinsed as per conventional method.

STEP 3—Yarn processing.

The stock was then dried and blended. The dry spinning process was adopted using 0.5% of spinning lubricant Nopcostat 725-A. The rest of the process was followed to have a tufted carpet.

STEP 4—Tip sealing process.

During the backing process the tufted sample, using the provision of the treated stock fiber, was subjected to a topical tip sealing spray treatment to 10% moisture add-on, comprising of following ingredients:

0.5% OWG of polymethacrylic polymer being a mixture comprising about 23 parts (a) a copolymer of methacrylic acid (described as Polymer H of U.S. Pat. No. 4,937,123 (Chang et al) using butyl acrylate instead of ethyl acrylate and the weight ratios being about 78.4 parts methacrylic acid, about 17.6 parts butyl acrylate, about 2 parts sulfated castor oil, and about 2 parts NaOH); about 3.4 parts (b) a partially sulfonated novolak resin; about 8 parts (c) (Witconate AOS at 39% solids); and about 64 parts water,.

0.5% OWG of anionic Fluoroaliphatic emulsion being a mixture as described in Example 8 of U.S. Pat. No. 4,264, 484 (Patel) comprising (a) a fluoroaliphatic radical- and chlorine-containing ester and (b) a water-insoluble addition polymer using a ratio of ester to addition polymer of about 1.7:2 rather than 1:2 with about 7.1 wt % (based on ester and addition polymer solids) Witconate AOS solids added.

The sample was then submitted to drying and curing at the same time as the latex backed hessian at the carpet mill.

After conditioning to ambient room temperature, the following tests were performed with results as described below:

| TESTS | SAMPLE | MINIMUM STANDARD |
|---|---|---|
| STAIN RELEASE: 24h | | |
| unworn sample | 6.0 | 6.0 |
| worn sample | 3.5 | 3.0 |
| STAIN RESISTANCE: | | |
| Oil repellency | 5.0 | 4.0 |
| Water repellency | 4.0 | 3.0 |
| ACC. DRY SOIL | 3.5 | 3.0 |
| COLORFASTNESS TO LIGHT: | 4.5 | 4.0 |
| Less than 1/12 std depth | | |

(for reference to test methods, please read part I)

IV. EXAMPLE OF WOOL STOCK SPENT BATH PROCESS APPLICATION

In the example, 1000 kg of wool in loose stock form was loaded in a commercial stock dye vat. The liquor ratio was 10:1

STEP 1—Application of fluorochemical:

Load the dye vat with 1000 kg of wool stock and 10,000 L. of water. Start circulation.

Add levelling agent.

Add dyestuffs.

Add acid.

Add magnesium chloride @ 0.5% on weight of wool (5 kg).

Add fluorochemical @ 0.5% on weight of wool (5 kg). The fluorochemical was a mixture of (a) water insoluble fluoroaliphatic radical and aliphatic chlorine-containing ester; (b) water insoluble fluoroaliphatic radical-containing polymer; and (c) water-insoluble fluoroaliphatic radical-containing compound selected from carbonylimino compounds and imine compounds described in Example 14 of U.S. Pat. No. 4,401,780 (steel) except that component (a) was about 69 wt. %, component (b) was about 16 wt. % and component (c) was about 15 wt. %.

The dyeing process was performed in the usual manner to the boil (98° C.). After the completion of the dye cycle, the spent bath was cooled to 70° C. as per normal process.

STEP 2—Application of stain resist:

The combined stain resist and surfactant was added in dilute form to the vat @ 4.5% on weight on wool (45 kg).

Sulphuric acid was added subsequently to achieve pH 2.4.

The bath was held for 30 minutes then discharged and the stock was rinsed for 10 minutes before discharging.

STEP 3—Yarn processing:

The stock was dried and blended with 0.5% spinning lubricant, Nopcostat 725-A; the moisture content was monitored to 16% at the blending stage to give 14% in the storage room.

The stock was carded and spun successfully without special attention.

The yarn was twisted into 2-ply, hanked and autoclaved as per normal process.

STEP 4—Tip sealing process:

During the backing process the tufted sample, using the provision of the treated stock fiber, was subjected to a topical tip sealing spray treatment to 10% moisture add-on, composing of following ingredients:

0.5% owg of polymethacrylic polymer being a mixture comprising about 23 parts (a) a copolymer of methacrylic acid (described as polymer H of U.S. Pat. No. 4,937,123 (Chang et al) using butyl acrylate instead of ethyl acrylate and the weight ratios being about 78.4 parts methacrylic acid, about 17.6 parts butyl acrylate, about 2 parts sulfated castor oil, and about 2 parts NaOH); about 3.4 parts (b) a partially sulfonated novolak resin; about 8 parts (c) (Witconate AOS at 39% solids); and about 64 parts water.

0.5% owg of anionic fluoroaliphatic emulsion being a mixture as described in Example 8 of U.S. Pat. No. 4,264,484 (Patel) comprising (a) a fluoroaliphatic radical - and chlorine-containing ester and (b) a water-insoluble addition polymer using a ratio of ester to addition polymer of about 1.7:2 rather than 1:2 with about 7.1 wt. % (based on ester and addition polymer solids) Witconate AOS solids added.

The sample was then submitted to drying and curing at the same time as the latex backed hessian at a carpet mill.

After conditioning to ambient room temperature, the following tests were performed with results as described below:

| TESTS | SAMPLE | MINIMUM STANDARD |
|---|---|---|
| STAIN RELEASE: 24h | 6.0 | 6.0 |
| unworn sample | 6.0 | 6.0 |
| worn sample | 3.5 | 3.0 |
| STAIN RESISTANCE: | | |
| Oil repellency | 5.0 | 4.0 |
| Water repellency | 3.0 | 3.0 |
| ACC. DRY SOIL | 4.0 | 3.0 |
| COLORFASTNESS TO LIGHT: | 5.0 | 4.0 |
| Less than 1/12 std depth | 4–5 | 4.0 |

(for reference to test methods, please read Continuous Application Example 1)

I claim:

1. A method for imparting to synthetic or keratinous fibrous material stain resistance to common household stains, said method comprising the steps of:

A. contacting said material with a mordant selected from the group consisting of aluminum sulfate, aluminum hydroxide and zirconium salts in an amount effective to impart to the fiber greater stain resistance than would be obtained absent the mordant;

B. contacting the material from step A. with an aqueous bath containing a at least one surfactant, selected from sulphonated and disulphonated surfactants, in an amount effective to allow diffusion of a stain resist chemical into the fibrous material, and stain resist chemical in an amount sufficient to substantially decrease adsorption of staining material by the fiber, said stain resist chemical being selected from the group consisting of sulfonated phenolic resins, naphthalene sulfonic acid, naphthalene sulphones and derivatives thereof, the pH of the bath being at 1.5 to 3.0; and provided that a fluorochemical is present, in either step A. or B. in an amount sufficient to provide improved stain resist properties to the fibrous material when compared to such material which has not been treated with the fluorochemical in combination with the other components recited above.

2. A method for imparting to synthetic or keratinous fibrous material stain resistance to common household stains, said method comprising the steps of:

A. applying to said material with a mordant which is trivalent or tetravalent and is selected from the group consisting of aluminum sulfate, aluminum hydroxide or a zirconium salt selected from zirconium sulfate or zirconium hydroxides and the proportion of mordant used is 0.5 to 2 weight percent, based upon the weight of fibrous material being 100 percent;

B. contacting the material from step A. in an aqueous bath having a pH of 1.5 to 3.0 containing at least one surfactant selected from sulphonated and disulphonated surfactants, the proportion of surfactant to fibrous material being in the range of 0.5 to 1.5 percent based on the fibrous material being 100 percent, and in an amount sufficient to substantially decrease adsorption of staining material by the fiber, said stain resist chemical phenolic resins, naphthalene sulfonic acid, naphthalene sulphones and derivatives thereof, provided that a fluorochemical is present, in either step A or B in an amount sufficient to provide improved stain resist properties to the fibrous material when compared to such material which has not been treated with the fluorochemical in combination with the other components recited above.

3. The method of claim 2 in which the fibrous material is wool and to which the following conditions apply:

i) step A. is undertaken in a dye bath, at 80° to 98° C., in the presence of a dye;

ii) the dye bath is emptied after dyeing is complete and before step B.;

iii) in the aqueous bath of step B.:

a) the weight ratio of water to wool is in the range of 15–100:1;

b) the surfactant comprises an anionic surfactant mixture of sodium xylene sulfonate or derivatives thereof and dodecylbenzenesulfonic acid or derivatives thereof, and the weight proportion of surfactant to wool is 0.5 –1.5 percent, based on the wool weight being 100 percent;

c) the weight proportion of fluorochemical to wool is 0.5–1.5 percent based upon the wool weight being 100 percent;

d) the stain resist chemical comprises naphthalene sulfonic acid or a derivative thereof and the weight proportion of stain resist chemical to wool is 0.5–5 percent, based on the wool weight being 100 percent; and e) the weight ratio of stain resist chemical to surfactant is in the range of 62/38 to 80/20, and, within the 38–20 surfactant portion, the sodium xylene sulfonate type surfactant is about 13–25 parts, and the dodecylbenzenesulfonic acid type surfactant is about 7–13 parts.

4. The method of claim 3 wherein the temperature of the aqueous bath of step B. is 45° TO 80° C., and it is maintained at that temperature for 15 to 60 minutes.

5. The method of claim 2 in which:

i) step A. is undertaken in a dye bath in the presence of a dye, and the bath of step A. remaining after dyeing is retained as a spent bath, the temperature of the spent bath being adjusted to 65°–75° C.;

ii) the stain resist chemical and surfactant are added to the spent bath as part of step B.

6. The method of claim 5 in which:

i) the [temperature of step B. is 65° to 75° C., and the duration of step B. is 10– 40 minutes; and ii) the proportion of stain resist chemical, stated as a percentage based upon the weight of fibrous material being 100 percent, is 1.5–5.0 percent.

7. The method of claim 6 in which the pH of the bath in step B. is 2.0–2.5.

8. The method of claim 7 in which fluorochemical is used in a proportion of 0.3–1.0 percent, based upon the weight of fibrous material being 100 percent, and the fluorochemical is added either immediately after addition of the dye in step A. or immediately before the addition of the stain resist chemical in step B.

9. The method of claim 8 in which the stain resist chemical comprises naphthalene sulfonic acid or a derivative thereof, and the surfactant is a mixture of sodium xylene sulfonate or derivatives thereof and dodecylbenzenesulfonic acid or derivatives thereof.

10. The method of claim 9 in which the weight proportion of stain resist chemical to surfactant is in the range of 62/38 to 80/20, and, within the 38–20 surfactant portion, the sodium xylene sulfonate type surfactant is about 13–25 parts, and the dodecylbenzenesulfonic acid type surfactant is about 7–13 parts.

11. The method of claim 2 in which the fibrous material is keratinous; the material is tufted and a backing material is applied to the underside of the tufting; and after tufting and the application of the backing, the further step of tip sealing is performed, said tip sealing step comprising applying to said tufted material a solution comprising a polymethacrylic resin and a surfactant blended fluorochemical.

12. The method of claim 2 wherein the surfactant is anionic and is selected from the group consisting of alkyl aryl sulphonated fatty amines; hydroxyethylated fatty amines; sodium alkyl diphenyl ether disulphonate; sodium dodecyl diphenyl oxide disulphonate; dodecyl (Sulfophenoxy) benzene sulphonic acid, disodium salt; oxybis (dodecylbenzene sulphonic acid) disodium salt; hydrotrope sodium xylene sulfonate; aryl sulphonates; fatty amine polyglycol ether (sulphonate ethylene oxide condensate); sodium salt of highly sulphonated oil/ethylene oxide condensate; oxybis (dodecylbenzene sulphonic acid) disodium salts containing at least 1 percent sodium sulfate and at least 3 percent sodium chloride; groups of alkylated diphenyl oxide disulphonates; and benzene sulphonic acid, dodecyl (sulphophenoxy) disodium salt, monosodium and didodecyl disulphonated diphenyl oxide.

13. The method of claim 2 in which the fluorochemical is selected from the group consisting of fluorochemical allophantes, fluorochemical polyacrylates, fluorochemical urethanes, fluorochemical carbodiimides and fluorochemical guanidines.

14. A method for imparting to keratinous material, stain resistance to common household stains, said method comprising the step of:

A. preparing said keratinous material in tufted form;

B. conveying said tufted keratinous material through a prewetting station and adding a first surfactant thereto, said first surfactant being selected from the group consisting of dioctyl sulphosuccinate and mixtures of sodium xylene sulfonate or derivatives thereof and dodecylbenzenesulfonic acid or derivatives thereof;

C. adding a mordant, selected from the group consisting of aluminum sulfate, aluminum hydroxide, zirconium sulfate and zirconium hydroxide, to the prewet keratinous material from step B. in an amount effective to impart to the fiber greater stain resistance than would be obtained absent the mordant;

D. contacting the keratinous material with an aqueous mixture of a further surfactant together with a divalent salt, an anionic fluorochemical, and a stain resist chemical in an amount sufficient to substantially decrease adsorption of staining acid colorants found in foods and beverages by the fiber, which mixture has a pH of 1.5–3.0, said further surfactant being selected from selected from the group consisting of alkyl aryl sulphonated fatty amines; hydroxyethylated fatty amines: sodium alkyl diphenyl ether disulphonate; sodium dodecyl diphenyl oxide disulphonate; dodecyl (Sulfophenoxy) benzene sulphonic acid, disodium salt: oxybis (dodecylbenzene sulphonic acid) disodium salt; hydrotrope sodium xylene sulfonate; aryl sulphonates; fatty amine polyglycol ether (sulphonate ethylene oxide condensate); sodium salt of sulphonated oil/ethylene oxide condensatei dodecyl (sulphophenoxy) benzene sulfonic acid, disodium salt, oxybis (dodecylbenzene sulphonic acid) disodium salts containing at least 1 percent sodium sulfate and at least 3 percent sodium chloride; groups of alkylated diphenyl oxide disulphonates; and benzene sulphonic acid, dodecyl (sulphophenoxy) disodium salt, monosodium and didodecyl disulphonated diphenyl oxide, said stain resist chemical being selected from the group consisting of sulfonated phenolic resins, naphthalene sulfonic acids naphthalene sulphones and derivatives thereof.

15. The method of claim 14 wherein the keratinous material is wool and:

i) said first surfactant is added to the tufted wool in a weight ratio of 0.5–4 percent, based on the weight of wool being 100 percent; and ii) the weight ratio of stain resist chemical to surfactant is in the range of 62/38 to 80/20, and, within the 38–20 surfactant portion, the sodium xylene sulfonate type surfactant is about 13–25 parts and the dodecylbenzenesulfonic acid type surfactant is about 7–13 parts.

16. The method of claim 15 wherein the mordant is present in proportion of 0.5 to 2 percent by weight, based upon the weight of wool being 100 percent.

17. The method of claim 14 wherein the weight proportions of various ingredients, based on the weight of keratinous material being 100 percent, are as follows:

i) further surfactant—0.5–4.0 percent;

ii. divalent salt—0.5–2.0 percent;

iii) anionic fluorochemical—0.5–2.0 percent; and iv) stain resist chemical—1.6–5.0 percent.

* * * * *